United States Patent [19]

Kohnen

[11] 3,963,381

[45] June 15, 1976

[54] DOUBLE FOOT VALVE FOR CRYOGENIC FLUID CONTAINING TANKS

[75] Inventor: Keith Kohnen, Emmaus, Pa.

[73] Assignee: Air Products and Chemicals, Inc., Allentown, Pa.

[22] Filed: May 21, 1975

[21] Appl. No.: 579,524

[52] U.S. Cl. ..... 417/360; 415/201; 222/333; 415/157

[51] Int. Cl.[2] ..... F04B 35/04

[58] Field of Search ..... 415/360, 201, 157; 222/333, 545; 251/210; 137/630.22

[56] References Cited

UNITED STATES PATENTS

| | | | |
|---|---|---|---|
| 2,384,254 | 9/1945 | Meredew | 417/360 |
| 2,912,003 | 11/1959 | Lagerwey | 251/210 |
| 2,978,150 | 4/1961 | Doelcher | 417/360 |
| 3,000,543 | 9/1961 | Paul | 417/360 |
| 3,369,715 | 2/1968 | Carter | 222/333 |
| 3,453,964 | 7/1969 | Hallworth | 417/360 |
| 3,625,639 | 12/1971 | Eggmann | 417/360 |
| 3,876,120 | 4/1975 | Haesloop | 222/333 |

*Primary Examiner*—Henry F. Raduazo
*Attorney, Agent, or Firm*—Russell L. Brewer; Barry Moyerman

[57] ABSTRACT

This invention relates to an improvement in an apparatus suited for removing liquid e.g., flammable from a bulk container comprising pumping equipment in the container, a fluid transmitting casing extending from an upper portion in the container to a lower portion and communicating with the pumping equipment, an inlet communicating with the pumping equipment, a fluid outlet at the upper part of the container communicating with the casing, a foot valve for sealing the inlet from the container when in a closed position and permitting fluid flow from the container through the inlet to said casing when in the open position, said foot valve including means responsive to lifting movement of the pumping equipment for closing said valve and a sealing gland at the top of the casing accommodating movement of the pumping equipment for permitting opening and closing of the foot valve without venting the casing. The improvement comprises a "double foot valve" comprising an inner poppet carrying a sealing surface and extending across said inlet for sealing engagement when in a closed position, and an outer poppet carrying a sealing surface and extending across the inlet for sealing engagement when in a closed position, the outer poppet carrying the inner poppet for independent axial movement.

4 Claims, 4 Drawing Figures

DOUBLE FOOT VALVE FOR CRYOGENIC FLUID CONTAINING TANKS

BACKGROUND OF THE INVENTION

Pumping equipment for removal of flammable fluids from large storage reservoirs have been utilized for some time. These storage reservoirs generally are used to provide additional capacity for natural gas or other types of fluids for use during peak load periods or for base load use. Typically the fluids are withdrawn as needed from the bottom of the reservoir in the liquid state.

Storage containers suited for storing of flammable fluids e.g., liquids include a "frozen hole" which is an underground liquified gas reservoir with the perimeter of the reservoir frozen by a brine solution or by liquified gases such as nitrogen or the like to form impervious shells or vessels. Such vessels generally are of metal construction with heavy insulation on the outside or prestressed concrete. Often these vessels are located on ships and used for the transporting of liquefied natural gas and other fluids.

DESCRIPTION OF THE PRIOR ART

A recent development has provided for submerged pumping systems which accommodate easy removal and replacing of the pumping equipment without loss of either fluid or pressure. In this type of pumping system a fluid transmitting casing was immersed into the reservoir to convey the liquified gas from the bottom to the top of the reservoir and a single foot valve was mounted at the intake end of the casing and biased to a closed position for sealing the interior of the casing from the reservoir. The pump and motor was suspended from the closed top of the container and passed through a shiftable packing gland accommodating movement of the pump and motor unit toward and away from the foot valve. When the pump and motor unit was lowered and placed on the foot valve, the weight of the pump and motor caused the foot valve to open and permit passage of fluid from the container to the top of the casing. When the pump and motor unit was raised in the casing, the foot valve was forced to a closed position by compression springs thereby sealing the interior of the casing from the reservoir and permitting removal of the pump and motor unit for repair or replacement without venting the reservoir.

Some of the basic objections to the submerged pumping systems for removing fluids from a large storage container, particularly flammable fluids such as liquified natural gas, related to the fact that the foot valve was not failsafe. Generally there was some leakage of gas through the foot valve into the casing and even though the conduit was purged with an inert gas to remove the initial charge of flammable gas, there still seemed to be an element of danger in that an explosive gas mixture could be attained when the casing was exposed to the atmosphere.

SUMMARY OF THE INVENTION

This invention relates to an improvement in an apparatus for pumping fluids from a storage container and permitting removal of pumping equipment in said container without loss of fluid or pressure comprising:

a fluid transmitting casing extending from the top to the bottom portions of said storage container and communicating with said pumping equipment;

an inlet at the bottom portion defining a passage for liquid to the pumping equipment;

a fluid outlet at the upper portion of the container communicating with said transmitting casing;

a foot valve for sealing the inlet to said pumping equipment from the storage container when in the closed position, and permitting fluid flow from the container to the pumping equipment and through said casing when in the open position, said foot valve including means responsive to the lifting movement of the pumping equipment for closing said valve; and a sealing gland at the top of the casing accommodating movement of the pumping equipment to permit opening of the foot valve without venting the casing;

the improvement which comprises:

a foot valve comprising an inner poppet carrying a sealing surface for sealing engagement with the inlet when in a closed position; and an outer poppet carrying a sealing surface for sealing engagement with the inlet when in the closed position, said outer poppet carrying said inner poppet for independent axial movement; and means for forcing said inner poppet and outer poppet to a closed position when said pumping equipment is lifted.

Preferably a port communicates with said double foot valve for permitting flow of gas between the sealing surface carried by said inner poppet and said sealing surface carried by said outer poppet.

Advantages of this invention include:

a double foot valve which is essentially failsafe in that two sealing surfaces are provided in series instead of one should one of the sealing surfaces fail e.g., because of dirt;

a double foot valve having sealing surfaces which work independently of each other whereby if one of the sealing surfaces fails the other valve, because of its independent movement, and series relationship, can maintain an effective seal;

a purge system between the sealing surfaces of the double foot valve for maintaining an inert barrier between the valves and providing enhanced sealing should one of the valves fail;

a double foot valve which has very few moving parts, is easy to manufacture, and has a flow pattern to the inlet to the pumping equipment which is almost equivalent of the single foot valves used in the past thereby causing very little loss in efficiency due to flow restriction.

THE DRAWINGS

DESCRIPTION OF THE PREFERRED EMBODIMENTS

Figure 1:
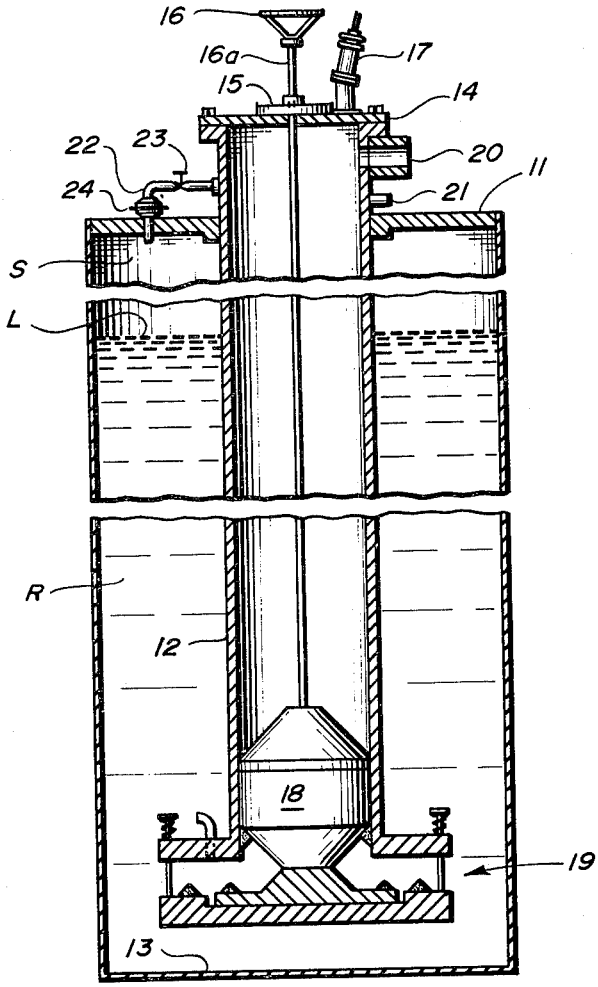
FIG. 1 is a view in vertical section, and partly broken away of the liquified gas storage reservoir showing a pumping unit and double foot valve constructed in accordance with the principles of this invention.

As shown in the drawings:

In FIG. 1, the reference 10 designates generally a metal container which is heavily insulated for providing a reservoir R for fluids e.g., cryogenic liquified gases and flammable fluids such as natural gas, hydrogen, propane, ethylene, butane, propylene and the like. The liquid level of the liquid in the reservoir R is illustrated at L close to the roof 11 of the reservoir. The space S between the liquid level L and roof 11 is filled with gas boiling off the liquid and pressurizing the reservoir. A positive pressure is maintained in the reservoir 10 to prevent intake of air with attendant fire and explosion hazards.

The assembly which includes a double foot valve and pump system of this invention is illustrated as including a casing 12 suspended from the roof 11 of the reservoir and extending vertically downward to a position adjacent but preferably spaced above bottom 13 of the reservoir. The casing section extending through the roof 11 is closed by a cover 14 carrying a sealing gland 15 and a handwheel 16. Bar 16*a* passes through sealing gland 15 for lifting the pump and motor unit 18. Cover 14 also carries a junction box 17 for an electrical connection.

A pump and motor unit 18 forming the submerged pumping equipment is lowered to the bottom of the casing 12 for opening the double foot valve generally described as 19. Fluid from the reservoir R flows through the inlet to the pump and is discharged from the pump filling the casing and discharged through outlet pipe 20. When the hand wheel 16 is manipulated to raise bar 16*a* through sealing gland 15, the pump and motor unit 18 is lifted off of double foot valve 19 whereupon the double foot valve is closed. Any fluid in the sealed-off casing 12 can be forced back to the reservoir R by introducing an inert purge gas, such as nitrogen, through inlet connection 21 thereby creating a purge pressure opening the double foot valve 19 and blowing any liquid or gas back to reservoir R. A pipe line 22 connects the casing with the top of the reservoir R. Shut off valve 23 and a check valve 24 permit venting the casing 12 to the reservoir following a pump shutdown.

Figure 2:
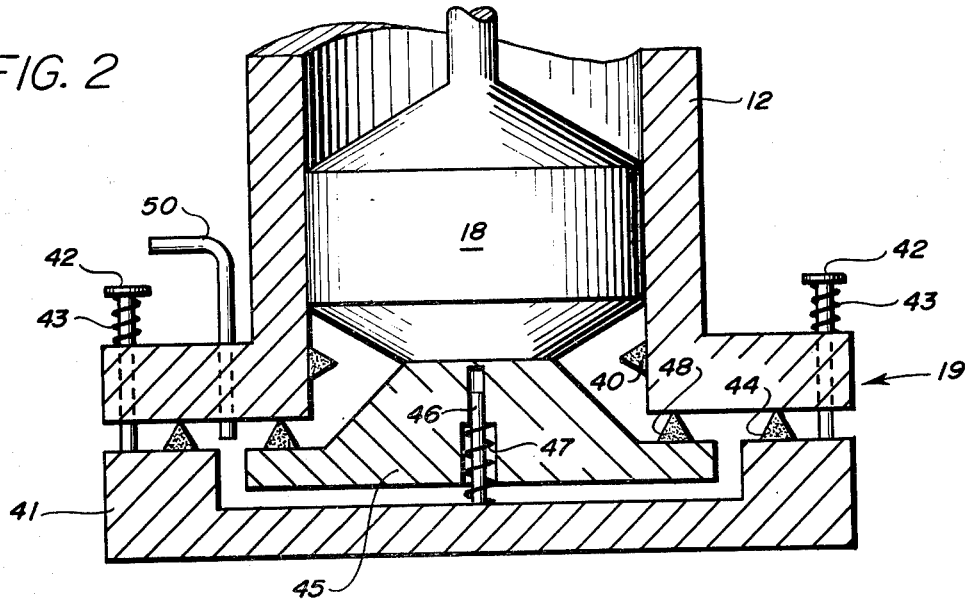
FIG. 2 is a broken vertical side view showing the pump and motor unit in elevation in a raised position thereby permitting the double foot valve to move towards the closed position.

In the view shown as FIG. 2, the pump and motor unit are shown in the raised position permitting the double foot valve to be in the closed position thereby sealing the inlet between the reservoir and the pumping equipment. Parts identical with the parts described in FIG. 1 have been marked with the same reference numeral. More particularly the pump and motor 18 is disposed in casing 12 for movement from top to bottom of the casing. When the pump is lowered to activate or open the double foot valve, it rests on seal 40 having a frusto-conical shape to prevent the discharge from the pump from passing back into the reservoir and to provide additional pressure on the pump for maintaining the double foot valve in an open position during operation.

The double foot valve 19, as shown in a closed position, comprises a generally circular outer poppet 41 which is suspended by a plurality of bolts 42 from a flange section on casing 12. Outer poppet 41 is forced toward the closed position by a corresponding plurality of springs 43. The outer poppet carries a first sealing surface 44 which provides for an effective seal against casing 12.

A generally circular inner poppet 45 rests inside outer poppet 41 for axial slidable movement on shaft 46 and is urged away from outer poppet 41 by spring 47. Inner poppet 45 has a loose fit on shaft 46 so that the inner poppet and outer poppet may move with respect to each other to provide for independent three dimensional movement of the respective parts. Inner poppet 45 carries a second sealing surface 48 which also seals against the flange of casing 12. The inner poppet has an arcuate curved surface 49 extending from its bottom portion to the top portion to provide a smooth, directing surface for liquid as it flows from the storage reservoir to the pump and motor unit 18.

A port 50 passes through the flange of casing 12 for communicating with the space between first sealing surface 44 and second sealing surface 48 of the outer poppet and inner poppet respectively. The port is connected to a line (not shown) for permitting introduction of an inert gas into the space between the sealing surfaces when the double foot valve 19 is in the closed position. The introduction of an inert gas serves to provide a "third" seal or inert barrier to enhance the effectiveness of the total seal between the storage container to the interior of the casing. Thus if the first sealing surface on the outer poppet leaks, the gas aids in the enhancement of the seal because it serves to drive the fluid back into the storage container or reservoir. On the other hand, if the second sealing surface leaks, the inert gas will pass into casing 12 and reduce the chance for obtaining an explosive mixture should some flammable gas be present.

Figure 3:
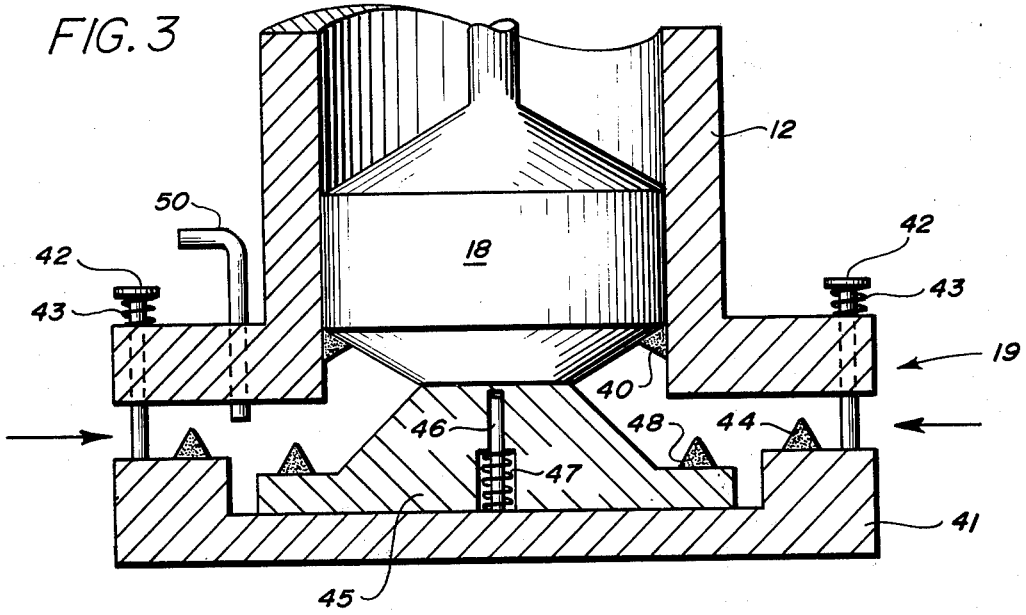
FIG. 3 is a broken vertical side view of the pump and motor unit of FIG. 1 with the pump and motor unit lowered in the casing for opening the double foot valve to permit flow of fluid from the reservoir through the inlet into the pumping unit.

In referring to FIG. 3, the view is shown as if the pumping equipment were in operation. In this view, the pump and motor 18 is lowered into casing 12 and rests on the frusto-conical shaped seal 40 for preventing passage of fluid from the discharge of the pump back into the reservoir R. The bottom portion of the pump and motor 18 rests on the top of inner poppet 45 causing it to move downwardly on shaft 46 thereby compressing spring 47 and engaging the surface of outer poppet 41 carrying the inner poppet. As the inner poppet is lowered further onto the surface of outer poppet 41, it causes outer poppet 41 to move downwardly for effecting compression of springs 43 on bolts 42. Thus, sealing surface 48 is released first and then sealing surface 44 is released. Port 50 is closed to the inert gas source and the liquid from the reservoir R is permitted to flow to the pump.

Figure 4:
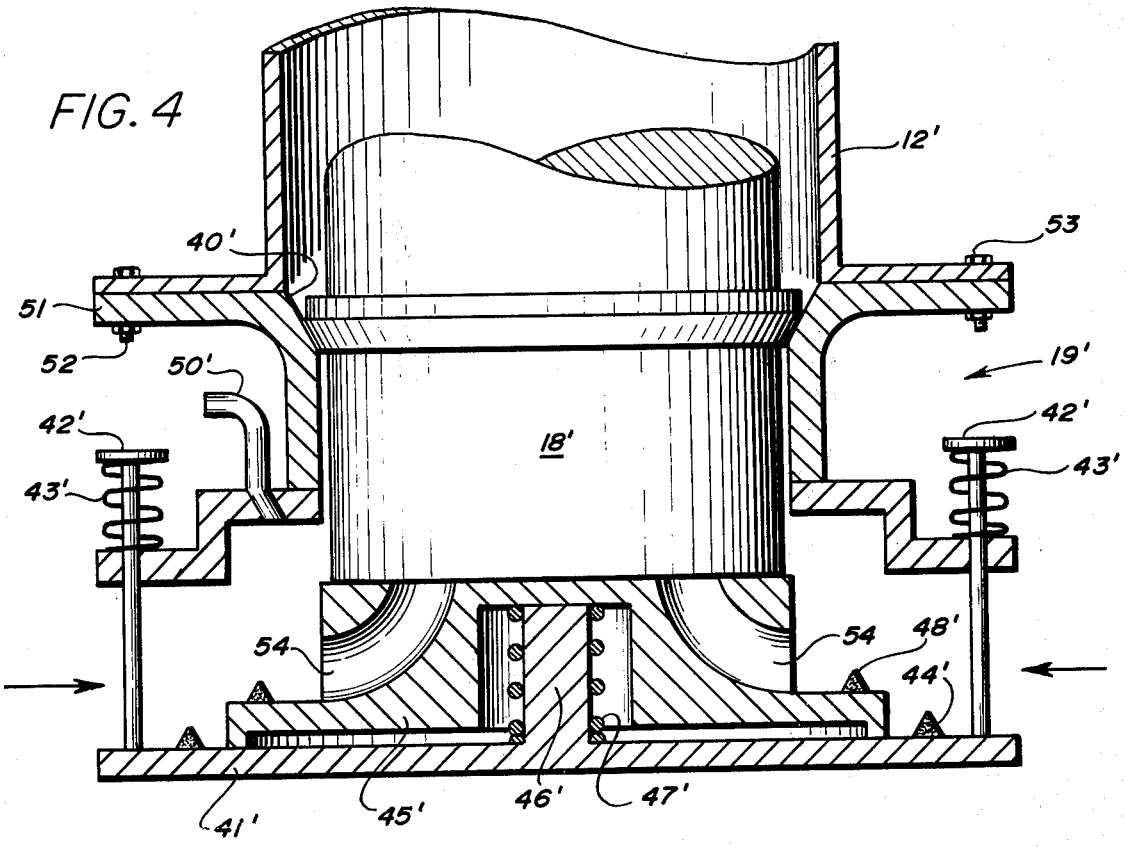
FIG. 4 is a broken elevational view of an alternate species of the double foot valve wherein the foot valve defines a plurality of passages for transporting fluid from the reservoir to the pumping equipment.

In FIG. 4 there is shown a different embodiment of the double foot valve showing the sealing surfaces in a different plane. The reference numerals employed in FIGS. 1 through 3 for the same parts in FIG. 4 will be used herein except that a "prime" will be used after each numeral.

In this drawing pump and motor 18' is lowered into casing 12' for seating on frusto-conical shaped seal 40' at its lowest position. In this case, the frusto-conical shaped seal 40' is located on a flange section 51 which is secured to casing 12' by a plurality of bolts 52.

Outer poppet 41' is supported by a plurality of bolts 42' and is forced to a normally closed position by a corresponding plurality of springs 43'. The outer poppet 41' carries a first sealing surface 44' for effecting sealing engagement against the flange section 51.

An inner poppet 45' is supported inside and on outer poppet 41' for axial movement on shaft 46' and is urged away from outer poppet 41' by spring 47'. Inner poppet 45' is generally circular in shape and is of slightly smaller diameter than the diameter of the flange section 51 connected to casing 12' for movement inside said flange sections. The inner poppet has a plurality of arcuate shaped passageways 54 therein for permitting flow of fluid from the reservoir through the inner poppet 45' and to the pump and motor 18'. The inner poppet 45', like the inner poppet shown in FIGS. 1 through 3 carries second sealing surface 48' which can engage the flange surface 51 for providing a double seal.

It is understood that the inner and outer poppet may carry a material suited for sealing e.g., polymeric materials or these materials may be carried by the casing when desired. All that is required is that a surface be carried by the inner and outer poppets which is effective for providing seals for closing the inlet of the casing to the reservoir.

In operation then the embodiments as shown in FIGS. 1 through 4 effectively seal the inlet, as generally marked by arrows in each of these figures, to the interior of the casing from the reservoir. In other words, when the pumping equipment is not in the casing, the double foot valve is forced to a normally closed position with a nitrogen purge between the seals. When the pumping equipment is lowered into the casing, it contacts the inner poppet forcing it toward the outer poppet thereby opening that particular portion of the valve. When when it engages the outer poppet, it causes it to move downwardly for opening the second portion of the valve. The inert gas purge is terminated and liquid can flow from the reservoir to the inlet of the pump for discharge into the casing by passing over the arcuate shaped surface of the inner poppet as shown in FIGS. 1 through 3 or through the arcuate shaped passageway in FIG. 4. There is very little flow restriction through the inlet to the eye of the pump when the sealing surfaces as shown in FIGS. through 3 are inessentially the same plane. Greater flow restriction is noted in the embodiment in FIG. 4 where the sealing surfaces of the inner poppet and outer poppet are not on the same plane. During shutdown the pumping equipment is raised in conventional manner therby permitting the sealing surface of the outer poppet to engage the flange of the casing first and then permitting the inner poppet to move axially upward for permitting engagement of its sealing surface with the second portion of the flange on the casing. The independent, axial movement provided by the double foot valve comprising the inner poppet and outer poppet and series sealing provide for great safety in that the movement of one of the portions for disengaging the sealing surface does not necessarily affect the sealing action of the other.

What is claimed is:

1. In an apparatus for pumping fluids from a storage container and permitting removal of pumping equipment in said container without loss of fluid or pressure comprising:

a fluid transmitting casing extending from the top to the bottom portions of said storage container and communicating with said pumping equipment;

an inlet at the bottom portion defining a passage for liquid to the pumping equipment;

a fluid outlet at the upper portion of the container communicating with said transmitting casing;

a foot valve extending across said inlet for sealing the passageway to said pumping equipment from the storage container when in the closed position, and permitting fluid flow from the container to the pumping equipment and through said casing when in the open position, said foot valve including means responsive to the lifting movement of the pumping equipment for closing said valve; and a sealing gland at the top of the casing accomodating movement of the pumping equipment to permit opening of the foot valve without venting the casing;

the improvement which comprises:

a foot valve comprising an inner poppet carrying a sealing surface and extending across said inlet for sealing engagement when in a closed position; and an outer poppet carrying a sealing surface and extending across said inlet for providing a second seal when in the closed position, said outer poppet carrying said inner poppet for independent axial movement; and means for forcing said inner poppet and outer poppet to a closed position when said pumping equipment is raised.

2. The apparatus of claim 1 which additionally comprises a port communicating with said foot valve for permitting flow of gas between the sealing surface carried by said inner poppet and said sealing surface carried by said outer poppet.

3. The apparatus of claim 2 wherein said inner poppet has an arcuately curved shaped surface for directing fluid to said pumping equipment.

4. The apparatus of claim 2 wherein said inner poppet has a plurality of passageways for directing fluid to the eye of said pumping equipment.

* * * * *